United States Patent [19]

Kratzberger

[11] Patent Number: 4,702,196

[45] Date of Patent: Oct. 27, 1987

[54] COATING DEVICE

[75] Inventor: Franz Kratzberger, Heidenheim, Fed. Rep. of Germany

[73] Assignee: J. M. Voith GmbH, Fed. Rep. of Germany

[21] Appl. No.: 831,936

[22] Filed: Feb. 20, 1986

[30] Foreign Application Priority Data

Feb. 20, 1985 [DE] Fed. Rep. of Germany ..... 3505769

[51] Int. Cl.[4] ..... B05C 5/02

[52] U.S. Cl. ..... 118/410; 118/413; 118/419

[58] Field of Search ..... 118/410, 413, 419; 427/356, 358

[56] References Cited

U.S. PATENT DOCUMENTS 4,369,731 1/1983 Damrau ..... 118/413 X 4,398,494 8/1983 Alheid ..... 118/413 X

FOREIGN PATENT DOCUMENTS 95770 2/1973 German Democratic Rep. ..... 118/410

2158371 11/1985 United Kingdom ..... 118/413

*Primary Examiner*—John P. McIntosh

*Attorney, Agent, or Firm*—Ostrolenk, Faber, Gerb & Soffen

[57] ABSTRACT

The invention concerns a coating device for coating a travelling web travelling past the coating device. A chamber for coating composition has an exit mouth, and pressurized coating composition exits the mouth into an application space between the mouth and the web. A doctor blade for the web is downstream of the application space. A damming strip with an edge spaced from the web is upstream of the application space. The damming strip defines an exit slot for excess coating composition in the application space. A flow body in the application space includes feed channels leading from the mouth toward the web and includes passage openings extending generally transversely of the feed channels for conducting the rotary flow of coating composition through the application space. The flow body has obstacles above the exit ends of the feed channels which make the flow therearound more uniform.

11 Claims, 4 Drawing Figures

COATING DEVICE

BACKGROUND OF THE INVENTION

The present invention relates to a coating device for coating a traveling web from a chamber of coating composition. Such a coating device is known from U.S. Pat. No. 4,250,211.

This type of coating device includes a coating composition application space defined between the mouth of the chamber for the coating composition, the doctor element for the composition at the downstream end of the application space and the web of material. The application space is limited on its inlet side with respect to the motion of the web of material by a damming plate, which is so shaped and of a length as to form a throttle slot in cooperation with the web of material, so that a pressure greater than atmospheric pressure can be maintained in the application space. It is beneficial to feed the coating composition to the application space from the chamber or reservoir for the coating composition in an amount considerably in excess over that amount actually used. In the prior art coating device, the excess may amount to about twenty times the amount of material required. Excess coating composition then passes out through the throttle slot along the web of material. This has the advantage that a uniform coat is obtained, particularly if the path between the application region of the coating composition and the point of the doctor where the excess coating composition is scraped off the web of material is of relatively short length.

However, this structure has the disadvantage that a rotary flow of the coating composition takes place in the application space. A large amount of air also accumulates in the center of the eddy. Air periodically leaves the application space through the throttle slot in the form of a plug or bubble of air. Further, the excess coating composition in the rotary flow must find a path, which is transverse to the stream of new or fresh coating composition that is being fed. That path leads to the damming slot located above the damming plate and into the open. This exiting of the composition takes place explosively because of the hydrodynamic pressure produced by the web of material. All of this leads to disturbances in the coating applied. Furthermore, the coating composition which spurts out presents a considerble danger of soiling and dirtying the surrounding parts.

SUMMARY OF THE INVENTION

The object of the present invention is to provide a coating device in which the coating being applied to the web is not disturbed by captive large quantities of air which have been enclosed for a long time and/or by excess coating composition which forces its way explosively in uncontrolled fashion out of the rotary flow.

Another object is to reduce the quantity of excess coating composition that is needed for proper coating of the web.

A further object is to accommodate and use the rotary flow that develops in the application space.

The objects are achieved in a coating device for a travelling web comprising a housing disposed at the travelling web that is to be coated, and the housing is shaped for defining an exit mouth that faces toward the web that is travelling past the mouth. The mouth is spaced a slight distance from the web, which defines an application space. The mouth is shaped and oriented for feeding coating composition towards the web. Coating composition is delivered into the application space at a pressure above atmospheric pressure. There is a doctor element or blade that is supported to the housing and downstream of the mouth in the path of travel of the web, and the doctor element extends toward the web. The application space for the coating composition is defined between the exit mouth from the chamber, the doctor element and the web.

Upstream of the application space there is supported on the housing a damming strip with an edge that is spaced a distance from the web for defining an exit slot from the application space, through which slot excess coating composition may escape from the application space.

A flow body is disposed in the application space upstream of the doctor element and downstream of the damming strip and it is located above the mouth of the chamber and extends toward, but is spaced from, the web travelling past it. The flow body is shaped for conducting the coating composition which is being fed from the mouth and into the application space, around the center of rotation of the coating composition application space which is around the axis that extends both across the web and across the application space. For accomplishing the foregoing purpose, arrayed along the direction across the web, the flow body has feed channels for the coating composition which extend from the mouth of the chamber across the flow body to open into the application space above the flow body. The feed channels generally extend parallel to the doctor element and lead toward the end of the flow body which is closer to the web. The feed channels alternate along the flow body with passage openings that extend across the flow body in a direction generally transverse to the feed channels and the passage openings pass the rotary flow in the application space. The passage openings are placed to pass the rotary flow in the region of the flow body close to the exit mouth. In an alternate arrangement, the flow body has a slightly rounded shape, curved slightly downstream of the travel of the web, in the direction toward the web. There are flow obstacles supported on the flow body above the feed channels for obstructing flow from the feed channels and for redirecting that flow for uniformity as the flow enters the application space.

DESCRIPTION OF THE DRAWINGS

The invention is explained below with reference to embodiments shown in the FIGS..

DESCRIPTION OF THE PREFERRED EMBODIMENTS

Figure 1:
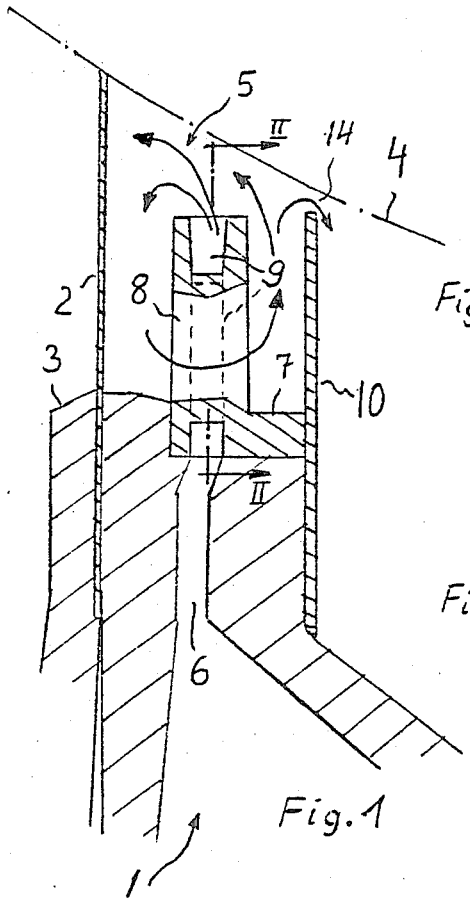
FIG. 1 is a cross-sectional view through one embodiment of the coating device of the invention.

Referring to FIG. 1, there is a chamber 1 for holding the coating composition. It is enclosed and defined by a housing that extends across the width of the web being coated. A coating blade 2 of spring material acts as coating doctor element. A pressure strip 3 fastens the coating blade 2 to the downstream end of the chamber housing. The blade 2 on the housing projects toward the surface of counter-roll 4. The blade defines the downstream end of the application space 5. The web of material to be coated, which passes over the counter-roll 4, is indicated in dashed line.

The coating composition passes out of the chamber 1, through its narrowed mouth 6, and into the application space 5 which is formed between the chamber mouth 6, the coating blade 2 and the web of material 4. The coating composition is preferably at a pressure greater than atmospheric.

The application space 5 is limited by a damming plate or strip 10 at the upstream side, i.e. on the side of that space where the web of material enters it. The strip 10 leaves open a throttle slot 14 alongside the web of material through which excess coating composition can leave the application space 5.

The entire device is of a width corresponding to the width of the web of paper, and therefore also the width of the counter-roll, and extends transverse to the counter-roll. The device has substantially the same cross section over its width. The showing of a side view has therefore been dispensed with.

A flow body 7 is located in the application space 5 and is supported on the housing. Across the width of the roll 4, the flow body has alternating feed channels 9, which extend from the chamber mouth 6 toward the roll 4 and are used for introducing the coating composition into the application space, and passage openings, which are transverse openings 8, for that rotary flow of the coating composition which is formed in the application space 5. This rotary flow is indicated by the unnumbered arrows in FIG. 1. As a result of the presence of the flow body 7, no vortex center, in which air could accumulate, can now form in the center of the rotary flow, for instance in the middle of the application space 5. Air is generally introduced into the application space 5, together with the coating composition from the chamber 1 through its mouth 6, on the one hand, and as a result of the speed of the web of material 5 and of the coating composition adhering to it.

The air in the application space is located essentially only at the circumferential periphery of the rotary flow. The air is introduced into the application space by the web. With the invention, after essentially a single passage through the application space 5, the air leaves the application space 5 again through the throttle slot 14, together with the excess coating composition. Furthermore, the excess coating composition can pass unimpeded out of the application space at the periphery of the center of rotation of the eddy flow, via the throttle slot 14.

Figure 2:
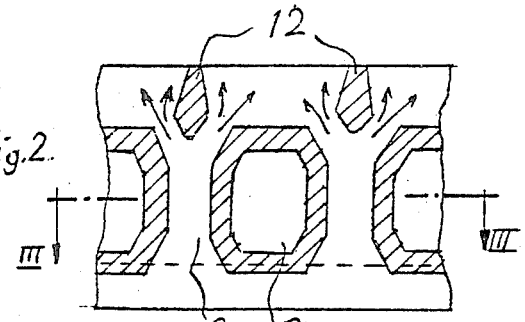
FIG. 2 is a cross-sectional view through FIG. 1 on the line II—II.
Figure 3:
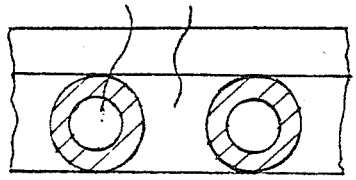
FIG. 3 is a cross-sectional view through FIG. 2 on the line III—III.

Ribs 12 in FIG. 2 on the flow body 7 have a streamlined configuration. They form obstacles to flow. they are located above the outlets of each of the feed channels 9. They make the distribution of the coating composition from the feed channels 9 more uniform. This avoids a possible new risk of streaking of the coating produced on the web. Substantial reduction of the wall thickness of the feed channels 9 can further substantially increase their inside cross sections.

There is the advantage that, due to the relatively quiet, undisturbed rotary flow, the coating device can operate with a relatively small excess of coating composition, for instance, only with 100% excess instead of an excess of 10 to 18 times. As a result, only a relatively small cross section of the feed channels 9 is already sufficient. The cross sections of the transverse openings 8 can therefore be made relatively large. The conditions of flow further are thereby improved, because the flow, removal of air, etc. are made uniform.

Figure 4:
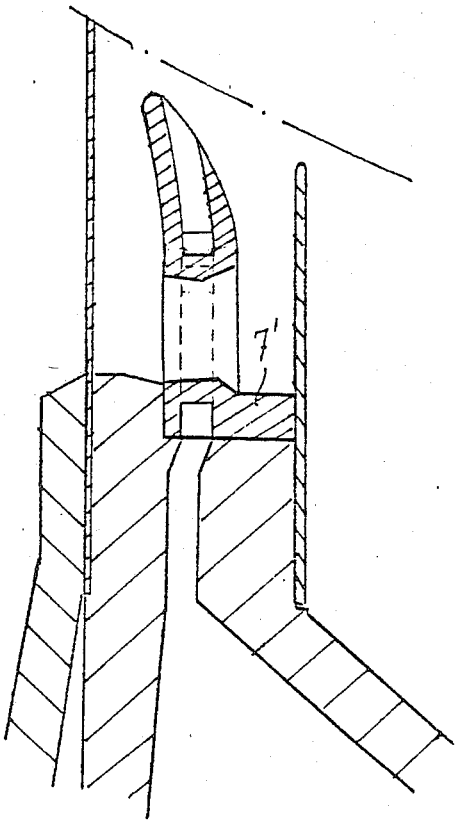
FIG. 4 shows another variant of the flow body in FIG. 1.

In the alternate embodiment of FIG. 4, the flow body 7' is shifted somewhat further toward the web of material than in FIG. 1 and is developed in a flow-favorable manner, i.e. it is substantially rounded, at its end portion. The ribs 12 could also be arranged somewhat further from the outlet of the feed channels 9, but in the extension of the channels.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A coating device for a travelling web, comprising:

a housing shaped for defining an exit mouth facing toward the web travelling past the mouth, and the mouth being spaced from the travelling web; the mouth being shaped for feeding coating composition toward the web;

a doctor element supported downstream of the mouth and in the path of the web and extending toward the web;

an application space for the coating composition being defined between the exit mouth, the doctor element and the web; a flow body in the application space, spaced upstream from the doctor element, located above the mouth, extending toward the web and spaced from the web, the flow body being shaped for conducting the coating composition, which is being fed from the mouth into the application space, around an axis across the web and across the application space and that axis defines a center of rotation of the coating composition;

arrayed in the direction across the web, the flow body having feed channels for the coating composition which extend from the mouth across the flow body to open into the application space, and also arrayed in the direction across the web, the flow body having passage openings across the flow body for passing the rotary flow of coating composition in the application space, the passage openings being placed to pass the rotary flow in the region of the flow body that is close to the exit mouth.

2. The coating device of claim 1, further comprising means for delivering coating composition at pressure above atmospheric pressure to enter the application space through the mouth.

3. The coating device of claim 1, further comprising a damming strip supported upstream of the application space with respect to the path of web travel. and the damming strip having an edge which is spaced a distance from the web for defining an exit slot from the application space.

4. The coating device of claim 3, wherein the doctor element and the damming strip are both supported to the housing.

5. The coating device of claim 3, wherein the doctor element is a flexible blade which extends to the web.

6. The coating device of claim 1, wherein the feed channels and the passage openings alternate along the flow body along the direction across the web.

7. The coating device of claim 1, wherein the feed channels generally extend parallel to the doctor element, and the feed channels lead toward the end of the flow body which is close to the web.

8. The coating device of claim 1, wherein the flow body has a slightly rounded shape, curved slightly downstream, in the direction thereof toward the web.

9. The coating device of claim 1, further comprising obstacles supported on the flow body above the feed channels for obstructing flow from the feed channels and for redirecting the flow for uniformity as the coating composition enters the application space.

10. A coating device for a travelling web, comprising:

a housing shaped for defining an exit mouth facing toward the web travelling past the mouth, and the mouth being spaced from the travelling web; the mouth being shaped for feeding coating composition toward the web;

a doctor element supported downstream of the mouth and in the path of the web and extending toward the web;

an application space for the coating composition being defined between the exit mouth, the doctor element and the web; a flow body in the application spaced, spaced upstream from the doctor element, located above the mouth, extending toward the web and spaced from the web, the flow body being shaped for conducting the coating composition, which is being fed from the mouth into the application space, around an axis across the web and across the application space and that axis defines a center of rotation of the coating composition;

arrayed in the direction across the web, the flow body having passage openings that extend across the flow body for passing the rotary flow of coating composition in the application space, and the passage openings being placed to pass the rotary flow in the region of the flow body that is close to the mouth.

11. The coating device of claim 10, further comprising a damming strip supported upstream of the application space with respect to the path of web travel, and the damming strip having an edge which is spaced a distance from the web for defining an exit slot from the application space.

* * * * *

UNITED STATES PATENT AND TRADEMARK OFFICE

CERTIFICATE OF CORRECTION

PATENT NO. : 4,702,196

DATED : October 27, 1987

INVENTOR(S) : Franz Krautzberger (Deceased)

It is certified that error appears in the above-identified patent and that said Letters Patent is hereby corrected as shown below:

On the title page Item (75)

change "Kratzberger" should read -- Krautzberger --.

Signed and Sealed this

Twelfth Day of April, 1988

*Attest:*

*Attesting Officer*

DONALD J. QUIGG

*Commissioner of Patents and Trademarks*